US005795270A

United States Patent [19]

Woods et al.

[11] Patent Number: 5,795,270

[45] Date of Patent: Aug. 18, 1998

[54] SEMI-RECUMBENT ARM AND LEG PRESS EXERCISING APPARATUS

[75] Inventors: Jim Woods, Paola; Dan Todd, Olathe, both of Kans.

[73] Assignee: Jim Woods, Paola, Kans.

[21] Appl. No.: 620,037

[22] Filed: Mar. 21, 1996

[51] Int. Cl.[6] ..... A63B 21/00

[52] U.S. Cl. ..... 482/72; 482/62

[58] Field of Search ..... 482/57, 72, 73, 482/62, 95, 96, 100, 133, 137, 138

[56] References Cited

U.S. PATENT DOCUMENTS

| | | | |
|---|---|---|---|
| 4,324,528 | 4/1982 | Svenning . | |
| 4,572,500 | 2/1986 | Weiss | 482/73 |
| 4,645,197 | 2/1987 | McFee | 482/130 |
| 4,684,126 | 8/1987 | Dalebout et al. | 482/72 |
| 4,688,791 | 8/1987 | Long . | |
| 4,722,520 | 2/1988 | Lee | 482/73 |
| 4,728,099 | 3/1988 | Pitre | 482/72 |
| 4,757,988 | 7/1988 | Szymski . | |
| 4,796,881 | 1/1989 | Watterson | 482/73 |
| 5,104,363 | 4/1992 | Shi | 482/72 |
| 5,123,641 | 6/1992 | Abboudi et al. . | |
| 5,186,700 | 2/1993 | Wang | 482/111 |
| 5,211,613 | 5/1993 | Friesl . | |
| 5,254,067 | 10/1993 | Habing et al. . | |
| 5,284,462 | 2/1994 | Olschansky et al. | 482/62 |
| 5,356,356 | 10/1994 | Hildebrandt et al. . | |
| 5,445,583 | 8/1995 | Habing . | |

*Primary Examiner*—Stephen R. Crow
*Attorney, Agent, or Firm*—Stinson, Mag & Fizzell, P.C.

[57] ABSTRACT

An exercise apparatus which supports a user in a semi-recumbent position and provides an arm pull/arm press assembly and a leg press assembly whereby the arm pull/arm press and leg press assemblies may be used simultaneously or independently of one another. The arm and leg press assemblies are each operable against variable air resistance means, and preferably against independent variable air resistance means such that the amount of resistance to the leg press exercise may be different or varied from that of the arm pull/arm press exercise.

22 Claims, 7 Drawing Sheets

SEMI-RECUMBENT ARM AND LEG PRESS EXERCISING APPARATUS

BACKGROUND OF THE INVENTION

1. Field of the Invention

The present invention is directed to the field of exercise equipment, and is more particularly directed to a multifunctional exercise apparatus which supports a user in a semi-recumbent position and enables the user to perform arm pull/arm press and leg press exercises simultaneously or independently of one another against varied and independent resistance. The apparatus may be used to selectively strengthen and develop the upper and/or lower body and for aerobic exercise and cardiovascular conditioning. In a preferred embodiment, resistance to the upper and/or lower body exercises is provided by independent variable air resistance means whereby the air resistance can be conveniently varied to meet the needs of the user without changing the exercise pace or rpm.

2. Description of the Related Art

Exercise and fitness regimens are becoming increasingly popular throughout the United States and in other industrialized countries. There are a wide variety of exercise devices or machines that are known in the art which may be employed in commercial gyms or at home. Insofar as available floor space, as well as the financial resources needed to purchase these machines, may be limited particularly in the case of home gyms, it is desirable to provide a multifunctional machine which can be used to perform a variety of different exercises for persons of different levels of fitness.

Exercise machines generally fall within two categories; namely, devices which focus principally on developing and strengthening specific muscle groups, and devices directed more to aerobic exercise and cardiovascular development. For instance, conventional leg press machines are used to develop specific muscles of the lower torso and legs. These machines generally provide a back rest to support a person in a semi-recumbent position and provide a means by which the person can push against resistance with one or more legs. Similarly, vertical bench press machines are intended to develop the arms, chest and shoulders of the user. The vertical bench press generally provides a seat and backrest to support the user in a semi-recumbent position whereby the user pushes his or her arms forward against resistance.

In the past, devices directed to the development of specific muscle groups have generally been performed with either bar and weight plates, dumb bells, or stand-alone or multifunctional weight stack machines which have a station for performing each exercise. Conventionally these machines have used weight stacks on a guide rod system to provide resistance against the arm or leg movement. The amount of resistance is varied by increasing or decreasing the amount of weight. Other resistance means such as elastic bands have more recently been developed which replace the weight stack and guide rod system. While these resistance means are less bulky and cumbersome than weights, the amount of resistance may be limited and cannot be conveniently changed.

Aerobic exercise or cardiovascular development equipment generally does not focus on the development of specific muscle groups, but instead requires movement of multiple muscle groups and places a uniformly high demand on the oxygen and blood circulation systems throughout the entire body. Examples of these type devices include conventional rowing machines, rider machines, treadmills, cycles, cross country ski machines and stair climber machines. These devices may support the user in an upright or semi-recumbent position and are generally restricted to use for a specific aerobic exercise.

Aerobic and cardiovascular development equipment has utilized different means for providing resistance against the user's efforts in conducting the exercise. Resistance has been provided by conventional friction means using a belt and drum assembly, through electronic means employing alternating or eddy current devices, and via pneumatic or hydraulic piston assemblies. Others have suggested using a fanwheel having narrow fan blades driven by the user's motion such that movement of the fanwheel is resisted by air. This air resistance has been utilized in stationary bicycles such as the Schwinn Air-Dyne®, for example. While these air resistance mechanisms are useful and relatively easy to maintain and repair, the amount of resistance can only be changed by increasing or decreasing the exercise pace or exercise rpm.

While the exercise devices previously known in the art are useful, there remains a need for different equipment that enables the user to perform specific muscle group development and aerobic exercise wherein the amount of resistance to these exercises can be conveniently varied to meet the needs of the user without changing the exercise pace or rpm.

Thus, one of the primary objects of the present invention is to provide an exercise apparatus that provides the comfort and support of a semi-recumbent exercise position and that will enable the user to engage in upper body movement and lower body movement in combination or independently of one another, so as to strengthen these muscle groups while undergoing aerobic or cardiovascular development.

Another object of the present invention is to provide an exercise apparatus which enables the user to engage in upper and lower body development against variable resistance.

A further object of the present invention is to provide such an exercise apparatus wherein variable resistance is provided by an air resistance means which may be conveniently adjusted to different levels of resistance without changing the exercise pace or exercise rpm.

Yet another object of the present invention is to provide a semi-recumbent exercise apparatus which enables the user to perform a leg press exercise against variable air resistance.

A related object of the invention is to provide a semi-recumbent exercise apparatus which enables the user to perform arm pull or vertical arm press exercises against variable air resistance, wherein resistance is maintained when both pressing in a forward direction and pulling in a rearward direction.

Yet a further object of the present invention is to provide a semi-recumbent exercise machine which enables the user to simultaneously perform leg press exercises and upper body arm pulling and arm pressing exercises against variable air resistance, wherein the resistance can be independently adjusted to be different as to the leg press and arm pull/arm press exercises respectively.

A related object of the present invention is to provide a semi-recumbent exercise machine whereby the resistance means for the arm pull/arm press exercise is a separate and independent resistance means from the resistance means for the leg press exercise.

Another object of the present invention is to provide a drive means for transferring the linear motion of arm pull/arm press exercises and/or leg press exercises into rotational or circular motion which may drive an air fanwheel resistance means.

A related object is to provide such a drive means which transfers forward and rearward linear motion into single direction rotational movement which may drive an air fanwheel resistance means.

Another object of the invention is to provide a variable air resistance means which may be used in exercise devices whereby the amount of resistance may be easily adjusted to different and varied degrees of resistance without changing exercise pace or exercise rpm.

A further object is to provide a semi-recumbent exercise machine which enables the user to perform a leg press exercise and an arm pull/arm press exercise, wherein the leg press and arm pull/arm press exercises may be performed independently of one another against different and varied resistance means and wherein the resistance means comprises a variable air resistant fanwheel.

SUMMARY OF THE INVENTION

These and other objects of the present invention are achieved by an exercise apparatus which supports a user in a semi-recumbent position and provides an arm pull/arm press assembly and a leg press assembly whereby the arm pull/arm press and leg press assemblies may be used simultaneously or independently of one another. The arm and leg press assemblies are each operable against variable resistance means, and preferably against independent variable resistance means such that the amount of resistance to the leg press exercise may be different or varied from that of the arm pull/arm press exercise.

In a preferred embodiment of the invention, the variable air resistance is provided by a fanwheel having blades that have variable pitch to vary the amount of air resistance to movement of the arm pull/arm press and/or leg press exercises. A separate fanwheel is combined with the arm press and leg press assemblies in order that the assemblies may be operated wholly independent of one another at different resistance levels. In this embodiment, a means for providing resistance to the arm pull/arm press when reciprocated in a forward or rearward direction is achieved by a drive assembly which converts the linear forward and rearward motion into single direction rotational movement which drives the fanwheel resistance means.

A related embodiment of the present invention is directed to the variable air resistance means which may be adapted for use as a resistance means on a variety of different exercise machines.

A further embodiment of the invention is directed to the drive means which converts linear forward and rearward movement of the arm pull/arm press and/or leg press to single directional rotational movement for driving the air resistance means in a consistent and continuous manner.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
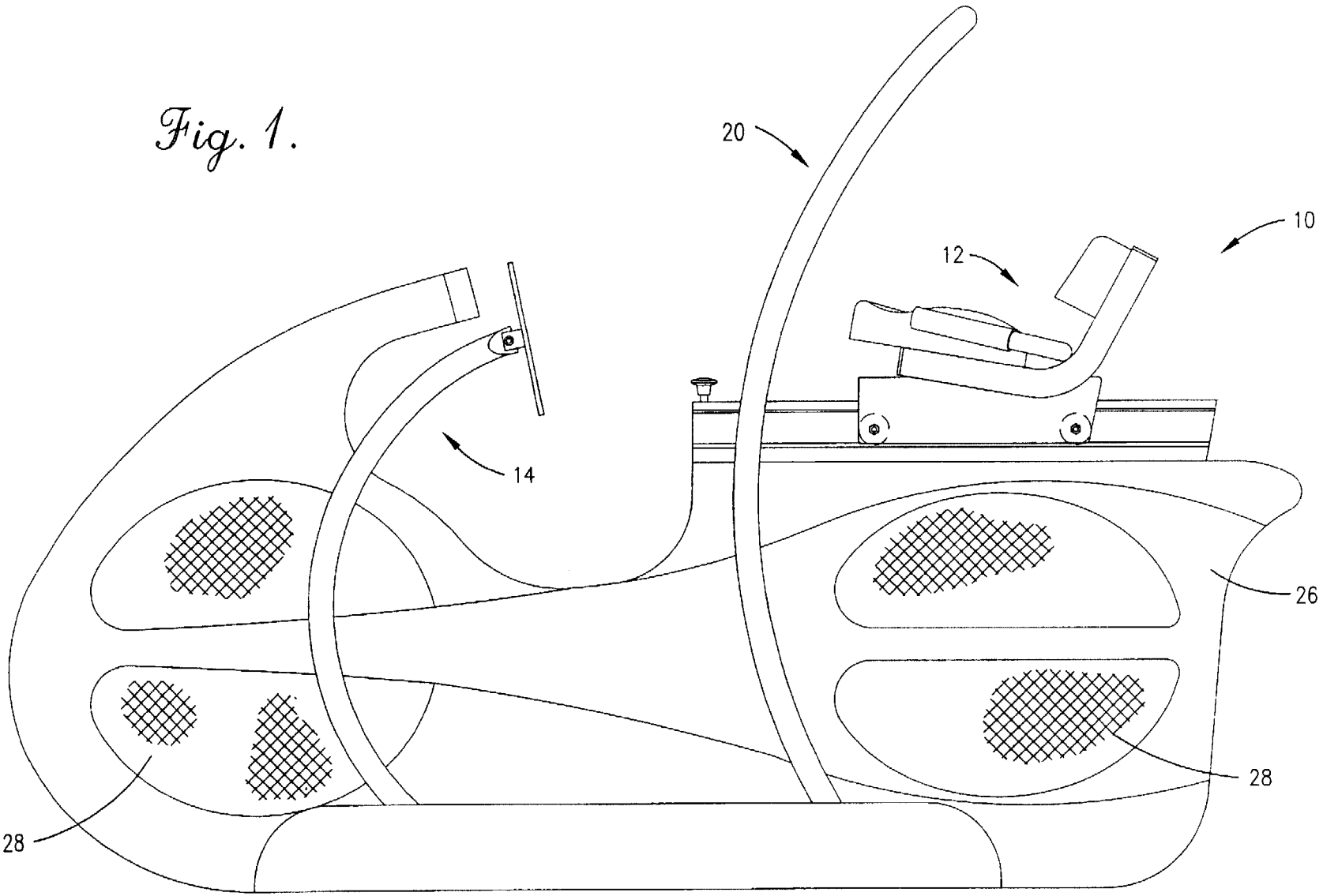
FIG. 1 is a left side elevational view of an exercise apparatus in accordance with the present invention wherein the housing for the apparatus including air supply vents for the variable air resistance assemblies is shown.
Figure 2:
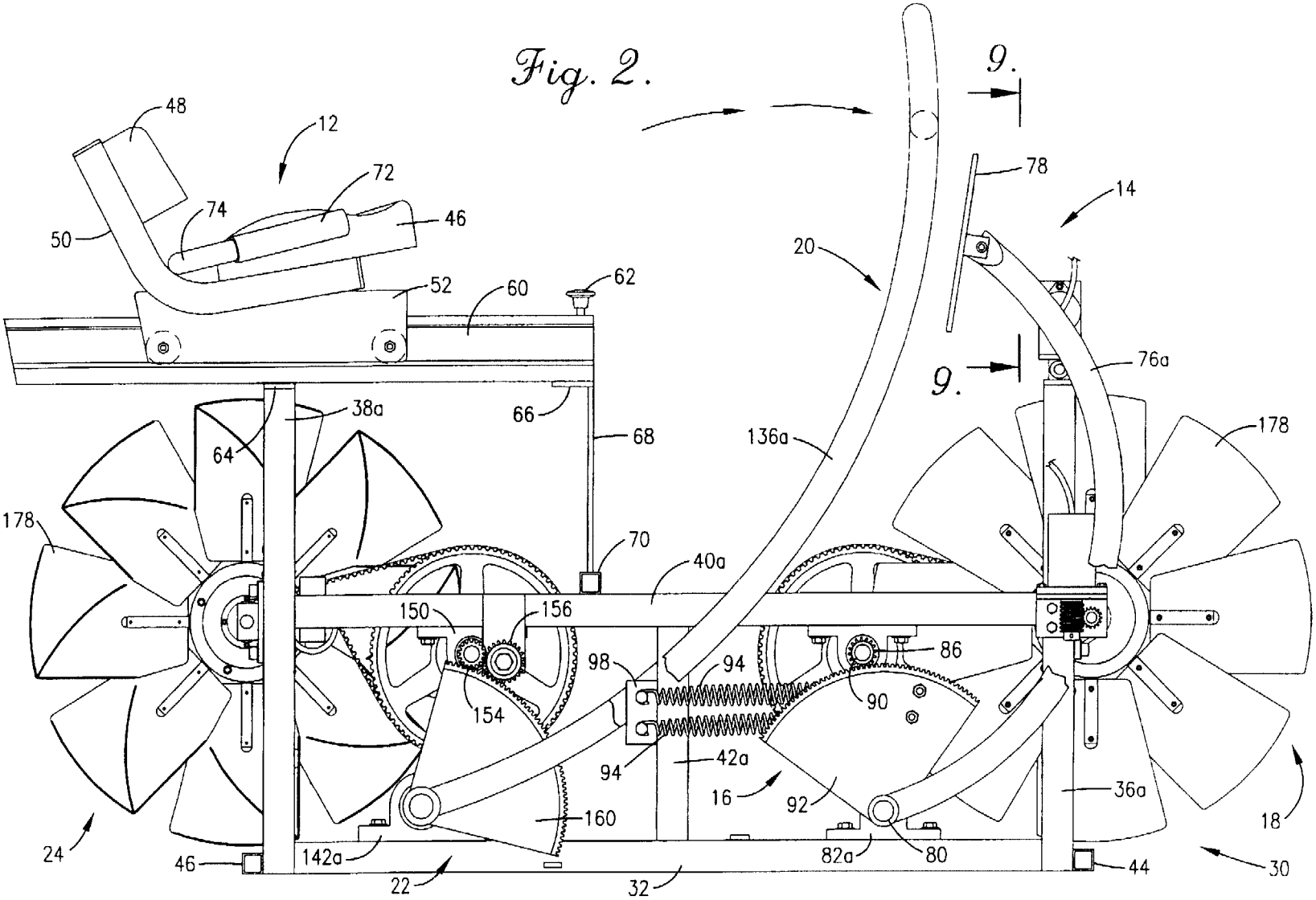
FIG. 2 is a right side elevational view of the apparatus of FIG. 1 with the housing being removed for purposes of showing the air resistance and drive assemblies wherein the arm pull/arm press assembly is shown reciprocated forward and the fanwheel blades of the resistance assemblies are shown pivoted to provide minimal air resistance.

Referring now to FIG. 2 of the drawings with more particularity, a semi-recumbent exercise apparatus embodying the principles of the present invention is illustrated and generally designated as numeral 10. Apparatus 10 is an exercise machine having a seat assembly 12 for supporting the user in a semi-recumbent position. The apparatus includes a leg press assembly 14 connected to a forward drive assembly 16 for driving a forward variable air resistance assembly 18 when the leg press is reciprocated forward. An arm pull/arm press assembly 20 is connected to a rear drive assembly 22 for driving a rear variable air resistance assembly 24 in uninterrupted fashion as the arm pull/arm press is reciprocated forward and rearward. As shown in FIG. 1, the leg and arm pull/arm press drive assemblies 16 and 22 and the variable air resistance assemblies 18 and 24 are enclosed by a housing 26 to protect persons from inadvertently catching clothing or otherwise contacting the assembly parts. The housing includes front and rear side air vents 28*a* & *b* for the supply and exhaust of air to the front and rear variable air resistance assemblies respectively. Air vents 28 may be comprised of plastic or other material similar to that of the housing including a mesh or screen pattern to permit air flow. Any means by which air flow is permitted adjacent the variable air resistance assemblies is considered suitable for these purposes.

Figure 4:
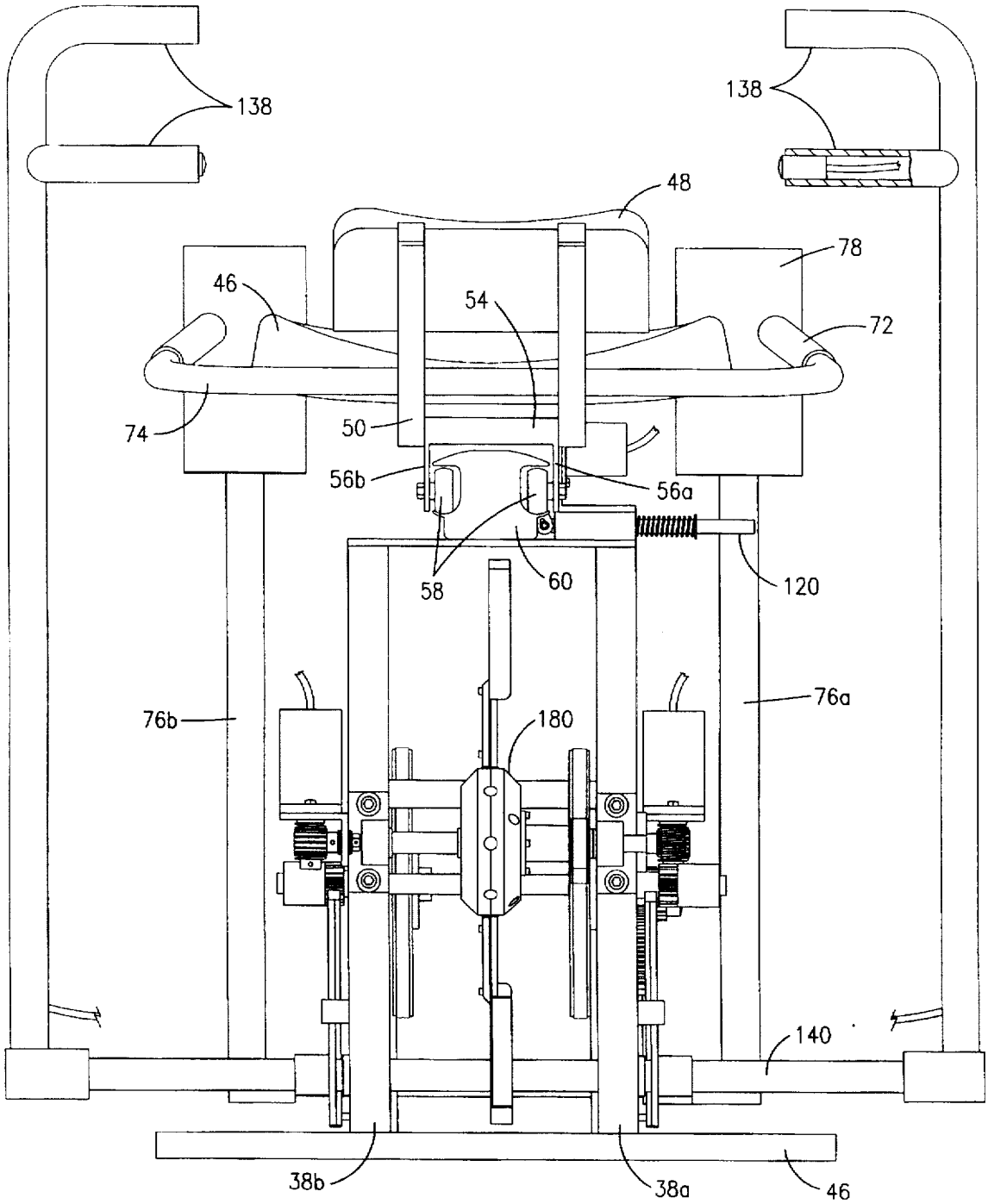
FIG. 4 is a rear view of the apparatus of FIG. 2, having portions removed for purposes of clarity.

As shown in FIGS. 2 and 4, the semi-recumbent exercise apparatus 10 is constructed on a longitudinal frame 30 which may be supported on the floor. The frame includes a pair of base support members 32 and 34 extending side by side generally from the front of the apparatus to the rear of the apparatus. Front vertical supports 36*a* & *b* extend upwardly from the front of base support members 32 and 34 respectively. Rear vertical supports 38*a* & *b* correspondingly extend upwardly from the rear of base support members 32 and 34. Frame support members 40*a* & *b* extend between the front vertical supports 36*a* & *b* and rear vertical supports 38*a* & *b* respectively intermediate the length of the vertical supports so as to add rigidity to the frame. Frame support members 40*a* & *b* are supported by vertical bars 42*a* & *b* which extend upwardly from base support members 32 and 34 respectively. Front lateral support 44 extends across the front of the frame and rear lateral support 46 extends across the rear of the frame a sufficient distance on either side of the frame so as to provide a stable footing for apparatus 10 on the floor surface.

The frame members and supports provide a high degree of stability to the frame during use and also provide structural elements on which various functional parts of the apparatus may be secured. Of course any frame configuration capable of meeting these objectives is considered suitable for purposes of the present invention.

The principle structural components of apparatus 10 particularly the frame components, are preferably fabricated from steel in various stock forms such as plate stock, angle stock or tubular stock, with square or rectangular steel tubing being preferred. The frame components are preferably welded together to form the frame, but may be attached by other conventional means. It is further anticipate that other types of materials including plastic materials may be used for components of the apparatus.

Seat assembly 12 is mounted on the frame and includes a seat cushion 46 and back cushion 48 secured on a pair of spaced apart L-shaped seat supports 50. Cushions 46 and 48 are of conventional construction comprising a rigid substrate of plywood or similar material, a foam cushioning material, and a vinyl or other material cover. The cushions are secured to the L-shaped seat supports 50 so as to firmly and comfortably support the seat and back of the user in a semi-recumbent position during operation of the apparatus.

The L-shaped seat supports 50 are each secured to opposite upper sides of a movable base 52 to enable the longitudinal position of the seat along the frame to be adjusted to accommodate users of different height. The movable base has a generally flat top 54 and side plates 56*a* & *b* extending downwardly from either side of the top. Rollers 58 are provided on the front and rear portions of the movable base by mounting the rollers via bolts or other means to the inner face of each side plate 56*a* & *b*. Looking to FIG. 4 it can be seen that the rollers 58 are mounted for sliding movement within tracks provided along either side of an elongate guide member 60.

A spring loaded locking knob 62 is provided on the forward end of the guide member which when lifted permits the movable base to slide along guide member 60. Once the seat has been moved to the desired longitudinal position, knob 62 may be released causing the movable base to be locked in secure position on the guide member. Any means known in the art for providing this locking mechanism is considered suitable for purposes of this invention. Furthermore, while one specific variety of seat adjustment mechanism has been described in detail, it will be appreciated that numerous other types of adjustment mechanisms are known in the art and suitable for purposes of this invention.

Looking to FIG. 2, guide member 60 is supported on the frame by mounting plates 64 and 66. Mounting plate 64 extends transversely across the width of the frame and is supported on the tops of rear vertical supports 38*a* & *b*. Mounting plate 66 is supported on the frame by a vertical plate 68 extending upwardly from a transverse mounting tube 70 which is secured transversely across the top of frame support members 40*a* & *b*. Mounting plate 66 is secured to the underside of guide member 60 at its forward end, and mounting plate 64 is secured to the underside of guide member 60 intermediate its length.

To assist the user in maintaining a comfortably seated position while performing exercises (particularly the leg press exercise by itself), hand grips 72 may be provided adjacent the user on the seat. As shown in FIGS. 2 and 4, the hand grips may be supported by a U-shaped member 74. Member 74 is welded or otherwise affixed to seat supports 50 such that the base of the U-shaped member is secured rearward of the seat cushion 46 and the arms of the U-shaped member extend along either side of the cushion. The hand grips are secured on the forward end of each arm and thereby remain fixed in position relative the seat as the longitudinal position of the seat on the frame is adjusted. Member 74 is preferably fabricated from round bar or tubing and the hand grips formed by covering the ends of the U-shaped support member with a slightly resilient material such as high-density foam or rubber for the comfort of the user.

A pair of identical generally upwardly extending leg press beams 76*a* & *b* are mounted at the forward end of frame 30. Beams 76*a* & *b* have an upper end to which foot pads 78 are pivotally mounted to provide a flat surface upon which the user's foot may engage the beams. Foot pads 78 optionally include heel cups so that the foot of the user will not inadvertently slip off of the pads during use. Beams 76*a* & *b* are affixed at their lower end to a transverse crossbar 80. Crossbar 80 is pivotally mounted through mounting plates 82*a* & *b* which are secured to the top of base support members 32 and 34 respectively. As shown in FIG. 2, each end of the crossbar 80 extends through an aperture in the corresponding mounting plate and is pivotally secured to the plate by a bearing or other means to enable rotational movement of the crossbar relative the plate. Beams 76 are securely mounted to each end of crossbar 80 which end extends outboard the mounting plates 82*a* & *b*. In this manner, beams 76*a* & *b* are connected by transverse crossbar 80 such that movement of the beams is in unison about the pivot axis of crossbar 80. Beams 76*a* & *b* have a curved shape which enables movement of the legs in correct biomechanical form so as to insure a comfortable and proper exercising position for developing the leg muscles.

Figure 3:
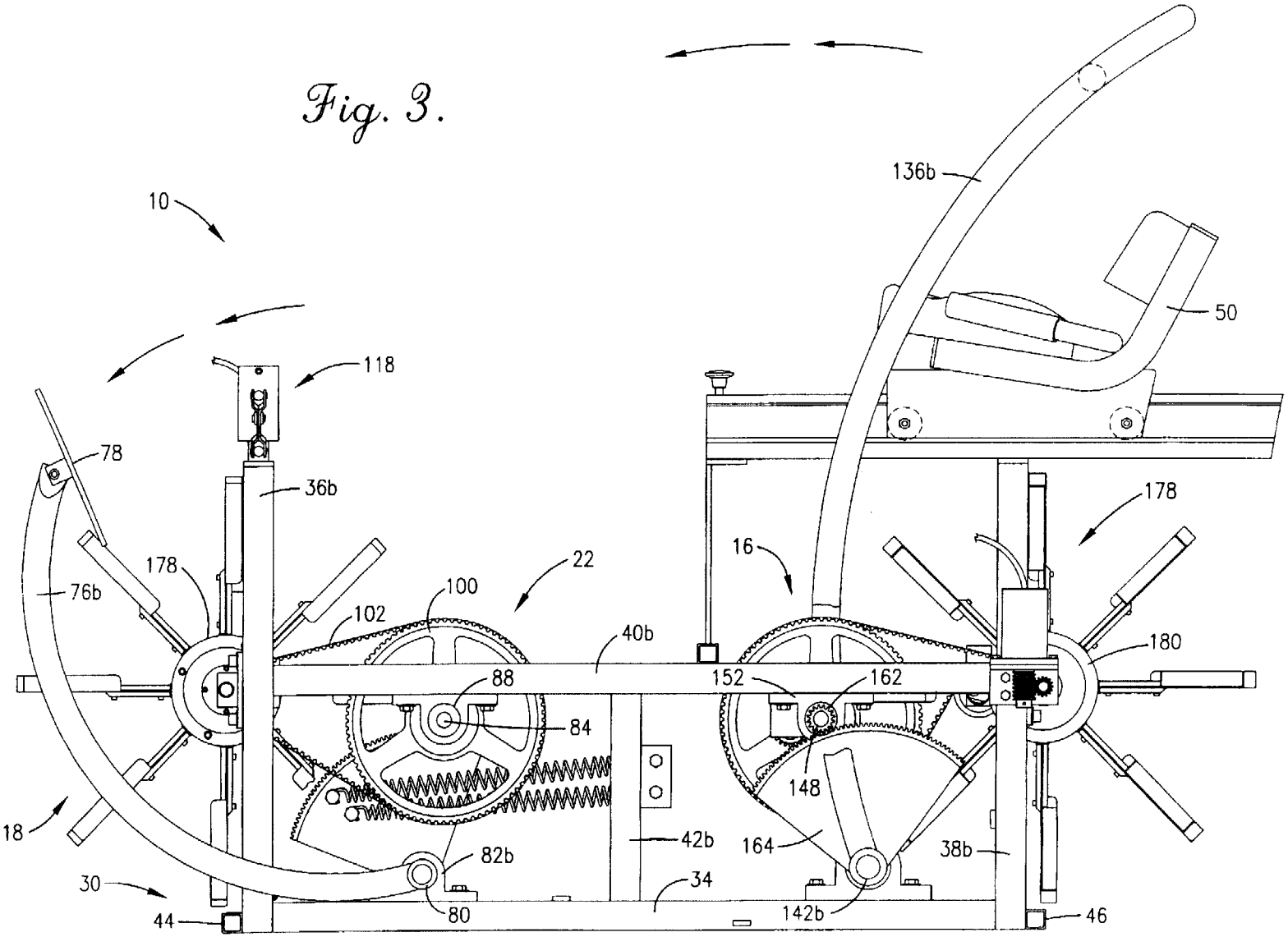
FIG. 3 is a left side elevational view of the apparatus of FIG. 2, wherein the arm pull/arm press assembly is shown reciprocated rearward toward the user and the leg press assembly is shown pressed or extended forward, and wherein the fanwheel blades of the air resistance assemblies are shown pivoted to provide maximum air resistance.

Each of the leg press beams pivots through an arc as indicated by the arrows in FIG. 3 such that a user may engage the foot pads with his feet and operate the leg press beams by pushing the beams through the indicated arc or a portion thereof with a pressing motion. Pivotal movement of beams 76*a* & *b* may be resisted by any variable resistance means known in the art. In the embodiment shown in the drawings, resistance is provided by variable air resistance assembly 18 which is driven by forward drive assembly 16. Looking to FIG. 3, leg press beams 76 may be reciprocated forward in the direction of the arrows by the user. The relatively linear motion of the beams is converted into rotational movement by forward drive assembly 16 which rotational movement drives the variable air resistance assembly 18.

Drive assembly 16 includes a transversely extending drive shaft 84 wherein each end of shaft 84 is journaled inside bearings 86 and 88. Bearings 86 and 88 are each supported by frame support members 40*a* & *b* respectively, and are preferably single direction bearings such that the drive shaft may only be driven by thrust loads acting in a single direction. In the preferred embodiment shown in the drawings, the shaft is provided to rotate in a rearward or counter-clockwise direction when viewing the apparatus from the right side (FIG. 2). For purposes of clarity, rotational movement of any element of the apparatus will hereafter be described as forward rotation when rotated in a clockwise direction when viewed from the right side (FIG. 2) of the apparatus. Rotational movement in a counter-clockwise direction when viewed from the right side will be referred to as rearward rotation. Suitable single direction bearings such as roller clutch bearings are available from Torrington Company of Torrington, Conn.

As seen in FIG. 2, a toothed gear 90 is mounted outboard of right bearing 86 for rotation with the drive shaft 84. Toothed gear 90 is driven by pie-shaped gear 92 comprising a pie-shaped sheet extending upwardly from a pointed base and having teeth corresponding to that of toothed gear 90 along its upper curvilinear edge. Gear 92 is attached at its base by welding or other means to crossbar 80 between the right leg press beam 76*a* and mounting bracket 82*a* such that linear motion of the leg press beams forward or rearward will cause rotational movement of cross beam 80 and consequently of gear 92. A pair of helical springs 94 are secured at one end to the pie-shaped gear 92 and mounted at a rear end via bolts to a mounting plate 96 supported by vertical bar 42. The helical springs 94 are attached in a manner to urge the leg press beams rearward when little or no pressure is applied to the footpads and to provide a certain amount of resistance to forward movement of the leg press beams.

Looking to FIG. 3, the left end of drive shaft 84 is journaled within a left bearing 88 which is mounted on the apparatus and supported by frame support member 40*b*. A pulley 100 is mounted inboard of the left bearing for rotation with the drive shaft 84. Pulley 100 is connected by a toothed belt 102 to a smaller diameter pulley (not shown) supported by front vertical support 36, wherein the smaller pulley is used to drive the forward variable air resistance assembly 18 as more fully explained hereafter.

Looking from the right side of the apparatus (FIG. 2), the user will be supported in a semi-recumbent position by sitting on the seat cushion 46 with his or her back supported by back cushion 48. The user may adjust the longitudinal position of the seat on the apparatus by lifting pin 62 and moving the movable base of the seat rearward or forward as needed. To perform the leg press exercise by itself, the user will position his or her feet on the footpads 78 and grasp the hand grips 72. By pressing his or her legs in a forward extended position, the leg press beams 76 will be pushed forward in the direction of the arrows causing crossbar 80 to be rotated in a forward or clockwise direction. Pie-shaped gear 92 mounted on the crossbar will likewise be driven forward causing toothed gear 90 and consequently drive shaft 84 to move in a rearward direction. Insofar as the single direction bearings on which the toothed gear is mounted will drive the drive shaft only in a rearward direction, the rearward thrust will then cause rearward rotation of the drive shaft and consequently rearward rotation of pulley 100 to thereby drive the air resistance assembly 18 as hereafter disclosed.

Once the user's legs are fully extended, the user will retract his or her legs taking pressure of the foot pads and leg press beams. Helical springs 94 will then urge the leg press beams toward the user causing the user to bend his or her legs. As the leg press beams 76 are reciprocated rearward, pie-shaped gear 92 is likewise thrust rearward driving toothed gear 90 in a forward direction. This forward movement will have no effect on the drive shaft since it is mounted in the one-way bearings in a manner to only rotate rearward. Once the user's legs are sufficiently bent, he or she will then again extend his or her legs pressing on the foot pads to complete another leg press cycle.

Figure 9:
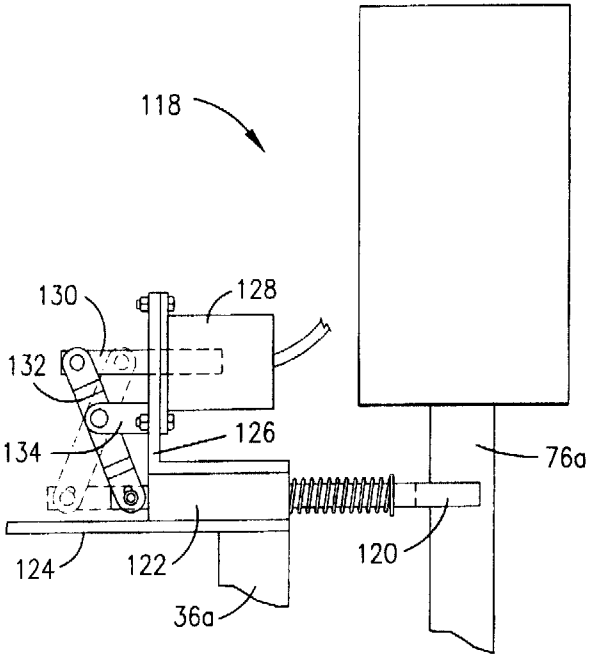
FIG. 9 is a rear sectional view of the apparatus of FIG. 2 showing the leg press locking assembly taken along line 9—9 of FIG. 2.

A leg press locking mechanism 118 may be included for blocking rearward movement of the leg press beams when the exercising apparatus is not in use. Any means known in the art for meeting this objective is suitable for this purpose including manual or electronic means. In the embodiment shown in FIG. 9, a spring-loaded locking bar 120 is electronically actuated to extend outward of the mechanism and block rearward movement of right leg press beam 76*a*. Bar 120 is supported in a housing 122 mounted across the top of front vertical supports 36*a* & *b* on a base 124. An L-shaped mounting plate 126 is secured along its horizontal section over the top of housing 122. A controller 128 is secured to the upper right side of the vertical section of L-shaped mounting plate 126 and operates to control movement of an actuator pin 130 extending away from the controller through an aperture in the vertical section of L-shaped plate 126. A linkage 132 is pivotally connected at its top to the free end of actuator pin 130 and pivotally connected at its bottom to that end of locking bar 120 which is not used to physically bar movement of the leg press. A pivot support bar 134 is securely attached to linkage 132 intermediate its length to stabilize pivotal movement about the pivot support bar.

In operation, the user may position his or her feet on the foot pad and indicate on the input means that he or she is ready to use the leg press. The input means will then trigger the controller to draw actuator pin 130 inward toward the controller causing linkage 132 to pivot about pivot support 134 forcing locking bar 120 away from the locked position and permitting rearward movement of the leg press beams. When the user is completed with the exercise, he or she may then indicate that fact on the input means. The input means will then trigger the controller to drive actuator pin 130 outward away from the controller causing linkage 132 to pivot about pivot support 134 and drive the locking bar 120 outward of the locking mechanism to a locked position.

The arm pull/arm press assembly 22 includes upwardly extending oars or arm levers 136*a* & *b* extending outwardly and upwardly from either side of the frame at a position intermediate the seat and leg press assemblies 12 and 14 respectively. A pair of handles 138 positioned one above the other extend inwardly from the upper end of each arm lever and may be used in developing different muscle groups of the upper body. Arm levers 136*a* & *b* are affixed at their lower end to opposite ends of a transversely extending crossbar 140. The crossbar 140 is pivotally mounted through mounting brackets 142*a* & *b* which are affixed via bolts or other means to the top of base support members 32 and 34 respectively. Each end of the crossbar 140 extends through an aperture in the corresponding mounting bracket and is pivotally secured through the bracket by a bearing or other means to allow free rotational movement of the crossbar within the bracket.

Arm levers 136*a* & *b* are securely mounted to each end of crossbar 140 outboard of mounting brackets 142*a* and b. In this manner, the arm levers are connected to one another by the crossbar such that movement of arm levers 136 is in unison about the pivot axis of crossbar 140. Forward movement of arm levers 136 will cause forward rotation of crossbar 140, and rearward movement of arm levers 136 will similarly cause crossbar 140 to rotate in a rearward direction.

Each of the arm levers 136 may be reciprocated forward and rearward by the user in the direction of the arrows as shown in FIGS. 2 and 3. Resistance to both forward and rearward movement of the arm levers may be provided by any resistance means now known or later developed in the art. In the preferred embodiment of the drawings, a variable air resistance assembly 24 is connected to arm levers 136. A rear drive assembly 22 converts the linear forward and rearward motion of the arm levers into single direction rotational movement which then drives rotation of the variable air resistance assembly.

Figure 11:
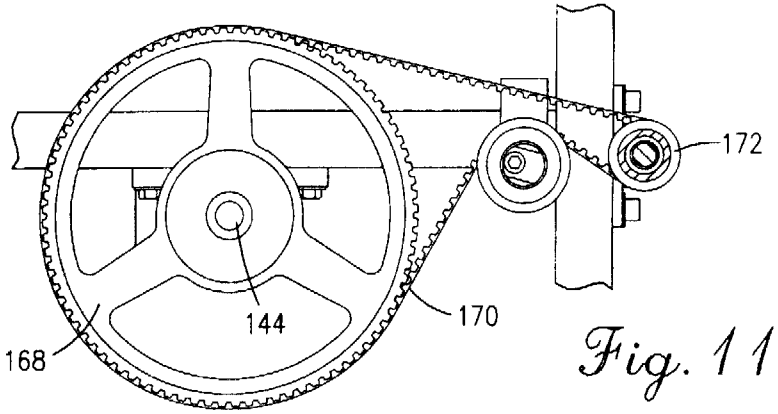
FIG. 11 is a side sectional view taken along line 11—11 of FIG. 10.

Looking specifically to FIG. 11, drive assembly 22 includes a drive shaft 144 extending transversely across the apparatus. Each end of the shaft is journaled inside right and left bearings 146 and 148 respectively which are supported by brackets 150 and 152 respectively which are secured via bolts to the underside of frame support members 40*a* & *b* respectively. Support brackets 150 and 152 include a central aperture through which the respective bearings are secured such that the drive shaft 144 is pivotally or rotationally mounted on the apparatus frame. Bearings 146 and 148 are single direction bearings which allow the drive shaft to be driven by thrust loads acting only in one direction. In the embodiment shown in the drawings, the shaft is journaled within the bearings to rotate in a forward direction. Single direction or one-way bearings such as one-way roller clutch bearings suitable for purposes of this invention are available from Torrington Company of Torrington, Conn.

Figure 10:
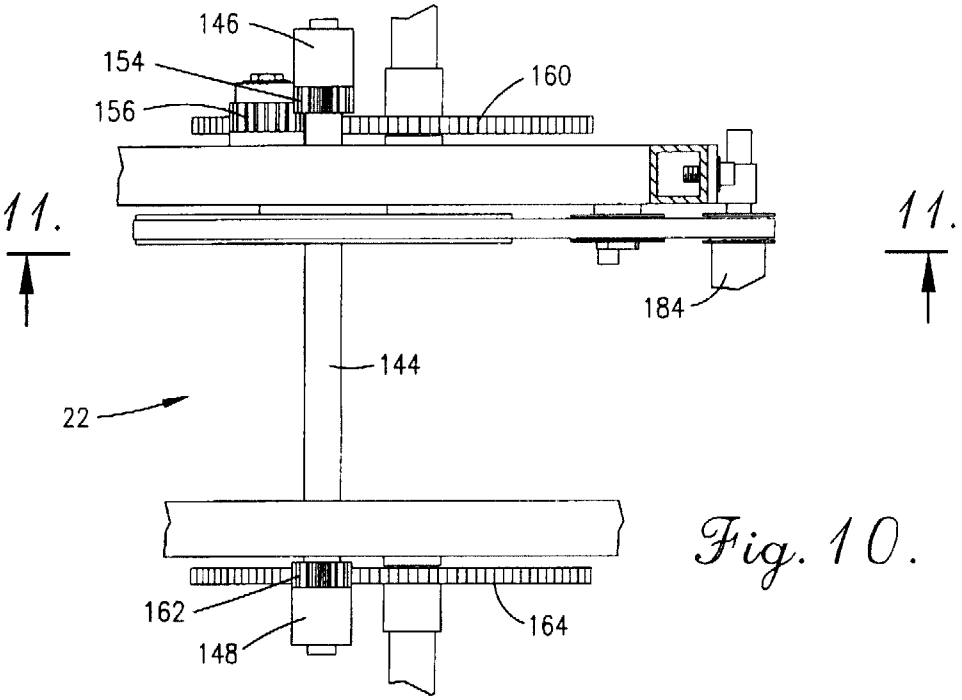
FIG. 10 is a top plan view of the apparatus of FIG. 3 showing the rear drive assembly which converts the linear motion of the arm pull/arm press assembly to single direction rotational movement and drives the variable air resistance assembly.

As best shown in FIGS. 2 and 10, a toothed round gear 154 is mounted inboard of right bearing 146 for rotation with drive shaft 144. Toothed gear 154 is driven by idler gear 156 which is secured by a mounting plate 158 to the right side of frame support member 40*a*. Idler gear 156 acts cooperatively with pie-shaped gear 160 to drive toothed gear 154. Pie-shaped gear 160 comprises a pie-shaped sheet extending upwardly from a pointed base and having teeth corresponding to that of idler gear 156 along its upper curvilinear edge. Pie-shaped gear 160 is mounted at its base by welding or other means to crossbar 140 whereby rotational movement of crossbar 140 will likewise cause rotational movement of pie-shaped gear 160 thereby driving idler gear 156 in the opposite direction. Idler gear 156 will consequently drive rotational movement of toothed gear 154 in the same direction as that of the crossbar.

Looking now to FIGS. 3 and 10, toothed gear 162 is mounted inboard of left bearing 148 for rotation with the drive shaft. The toothed gear 162 cooperatively acts with pie-shaped gear 164 comprised of a pie-shaped sheet of metal extending upwardly from its pointed base and having gear teeth corresponding to that of toothed gear 162 along its upper curvilinear edge. Gear 164 is attached at its base by welding or other means to crossbar 140 such that rotational movement of crossbar 140 will cause similar movement of the pie-shaped gear 164, thereby driving toothed gear 162 in the opposite direction.

When arm levers 136 are pushed forward, the crossbar 140 and pie-shaped gears 160 and 164 are rotated forward driving right toothed gear 154 in a forward direction via idle gear 156 and left toothed gear 162 in a rearward direction. Insofar as each gear is mounted on the one way bearings which allow the shaft to be driven only upon forward thrust, the forward movement of right toothed gear 154 will drive forward movement of drive shaft 144. The rearward movement of toothed gear 162 will not drive or otherwise affect movement of the shaft. When arm levers 136 are pulled rearward toward the user, the crossbar 140 and pie-shaped gears 160 and 164 are similarly rotated rearward driving the right toothed gear in a rearward direction via idle gear 156 and left toothed gear 162 forward. The rearward movement of right toothed gear has no effect on the shaft, while the forward movement of left toothed gear 162 drives the shaft. In this manner, forward rotational movement of drive shaft 144 is achieved by both forward and rearward movement of the arm levers 136.

Looking to FIGS. 10 and 11, a pulley 168 is secured to drive shaft 144 inboard of right bearing 146 and is mounted for rotation with the drive shaft. Pulley 168 is connected by toothed belt 170 to a ring shaped smaller diameter pulley 172. To ensure proper and consistent tension on the belt during the transition between forward and rearward movement of the arm levers, tension pulley 176 is provided to engage the toothed belt 170 along one side. In operation, forward movement of drive shaft 144 (driven by the forward and rearward movement of arm levers 136 as described above) causes forward rotation of pulley 168 thereby driving toothed belt 170 around ring shaped smaller pulley 172 to rotate the smaller pulley in a forward direction.

The forward and rearward variable air resistance assemblies 18 and 24 each provide variable resistance against movement of the leg press and the arm pull/arm press assemblies 14 and 22 respectively. Looking to FIGS. 5 and 11, the variable air resistance assemblies each comprise a fanwheel 178 having a central hub 180 with air vanes 182 extending circumferentially outward of the hub equidistant from one another. While the description of the air resistance assembly will hereafter be made with reference to the drawings of the rear assembly 24, it should be understood that a separate assembly is mounted on the apparatus for the leg press and arm pull/arm press assemblies respectively and that these resistance assemblies operate in the same manner.

Figure 5:
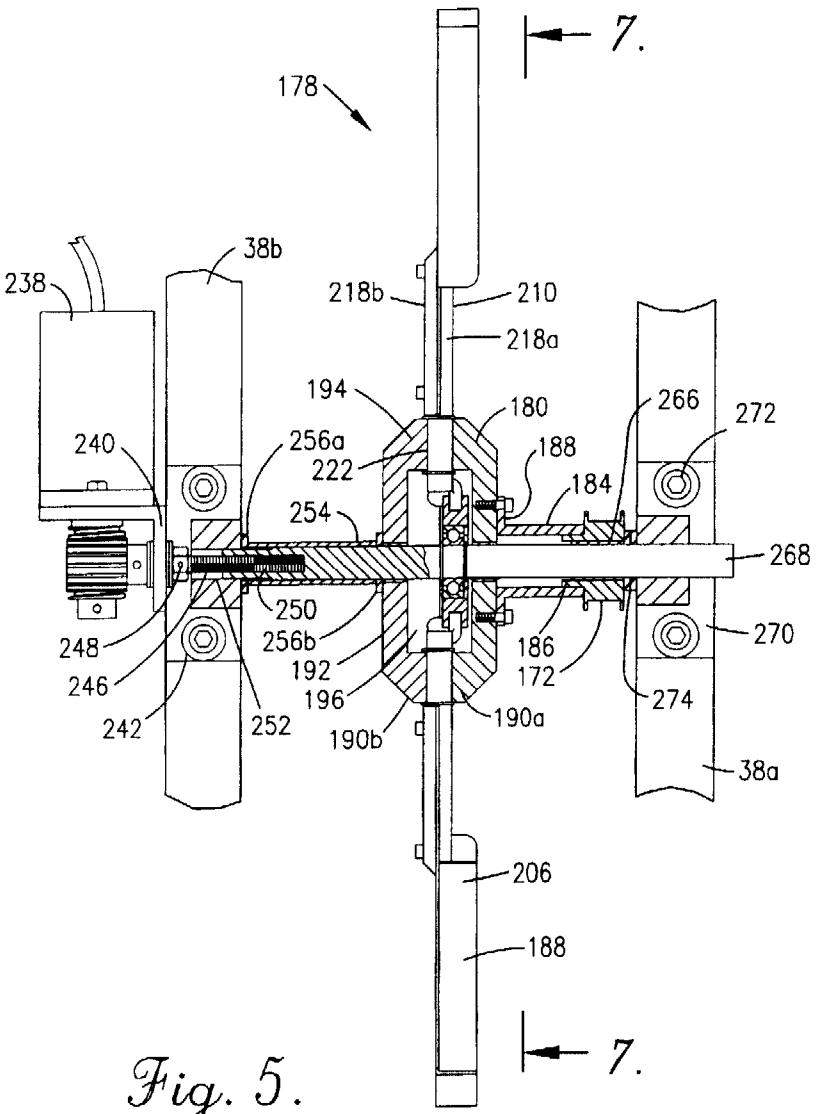
FIG. 5 is a rear sectional view of the apparatus of FIG. 2 showing the variable air resistance assembly with the fanwheel blades pivoted to provide minimal air resistance.

As shown in FIG. 5, drive sleeve 184 fits over a peripheral flange 186 extending toward the fanwheel from the inner edge of the side of the ring shaped smaller pulley 172 and is thereby secured to the smaller pulley. The drive sleeve 184 includes at its opposite end a peripheral outwardly extending flange 188 which is secured via bolts to the side of hub 180. In this manner, rotational movement of smaller pulley 172 causes sleeve 184 and fanwheel 178 to similarly rotate.

Hub 180 is comprised of a pair of rounded hub facings 190*a* & *b* each having a generally flat central section 192 and a peripheral outwardly extending ring section 194. Hub facings 190*a* & *b* are fitted together and secured along the end edges of their respective ring sections 194 so as form a hub having a hollow center 196. Each air vane 182 comprising a blade 198 and spoke 210 is pivotally attached to the hub wherein the blades may be pivoted to a position generally parallel the longitudinal axis of the apparatus (FIG. 2) such that minimal air resistance is encountered as the fanwheel is rotated, or to a position generally transverse the longitudinal axis of the apparatus (FIG. 3) such that a maximum amount of air resistance is encountered as the fan wheel is rotated.

Figure 6:
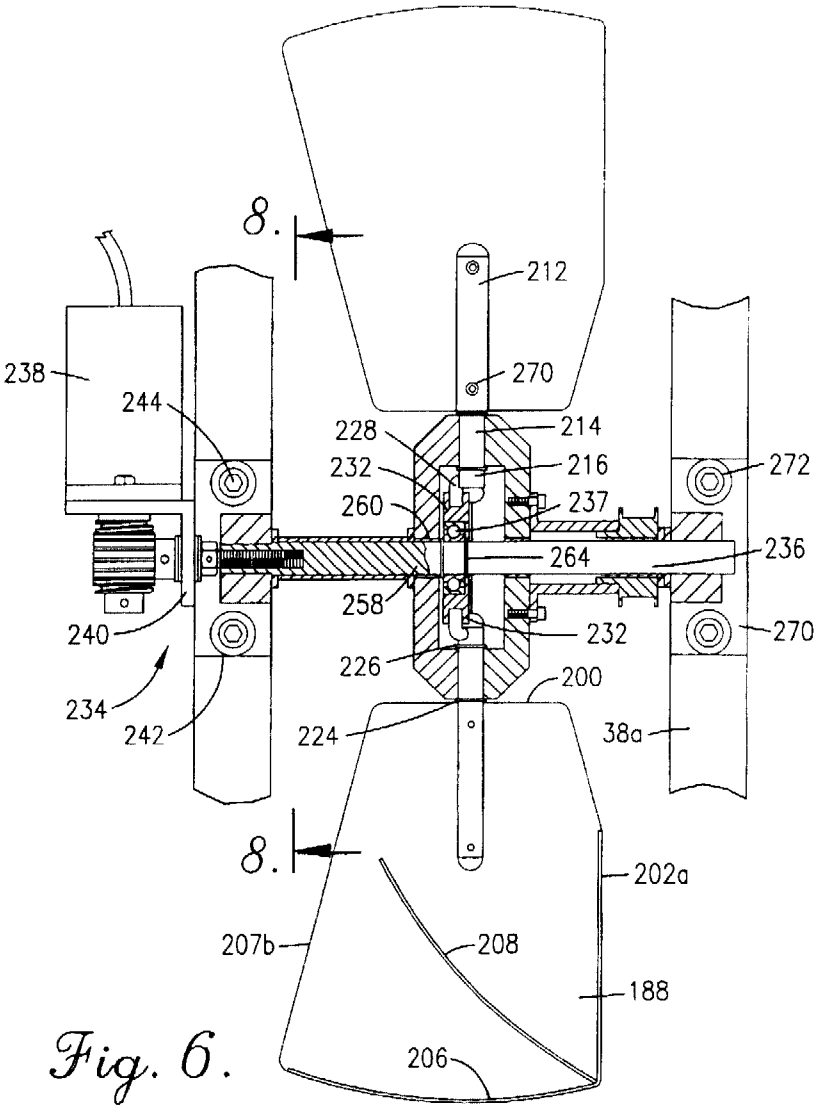
FIG. 6 is a rear sectional similar of FIG. 5 except the fanwheel blades are pivoted to provide maximum air resistance.

Each blade 188 is preferably configured to provide maximum resistance against rotational movement of the fanwheel when the blade is pivoted transverse the axis of the apparatus as shown in FIG. 3. Looking to FIGS. 5 and 6, blade 188 preferably has a fan configuration comprised of a relatively straight bottom edge 200, side edges 202*a* & *b* extending upwardly and outwardly from the bottom edge at an angle, and a curvilinear top edge 204. As best shown in FIG. 6, a portion of the side edge 202*a* and of the top edge 204 is folded to form a flange 206 extending generally perpendicular the direction of the blade surface. An angled vein 208 comprised of a strip of metal or other material extends from the corner of flange 206 downwardly and transversely across the surface of the blade. This particular design of blade is believed to provide additional air resistance when the blades are rotated about the hub 180. The flange is provided on that face of the blade which is the leading face during rotation of the fanwheel. Thus, for example, the forward variable air resistance assembly 18 is driven in a rearward direction and thus the blades are fitted on the fanwheel such that the flanges 206 project from the rear face of the blade. In the rear air resistance assembly 24, the fanwheel is rotated forward such that the blades are affixed with the flange projecting from the forward surface of the blade.

Blades 198 are secured circumferentially to hub 180 via cylindrical spokes 210. Each spoke 210 has three sections; namely, a top clamp section 212 which is used to secure the blade to the spoke, an intermediate section 214 which is secured to and extends through the hub, and a bottom pivot section 216 which provides a means by which the blade 198 may be pivoted to adjust air resistance. Top clamp section 212 is vertically split into two halves 218*a* & *b* and blade 198 is centered and fitted between the two halves with the bottom edge 200 of the blade flush with the bottom edge of the clamp section 212. The two halves 218 are secured to tightly sandwich and fix the blade in position by screws or other attachment means 220 secured through the two halves 218 with blade 198 positioned therebetween.

Intermediate section 214 of each spoke generally comprises a solid or hollow cylinder fitted through a bore hole 222 in the hub which extends from the outside into the hollow center 196 of the hub. The bore holes are positioned equidistant from one another and circumferentially around the hub 180 along the interface of the hub facings 190*a* & b. Snap rings 224 and 226 are fitted around the spoke on the outside and the hollow inside of the hub respectively so as to seal the spoke in place and eliminate resistance to rotational movement of intermediate section 214 within the bore hole 222.

Figure 7:
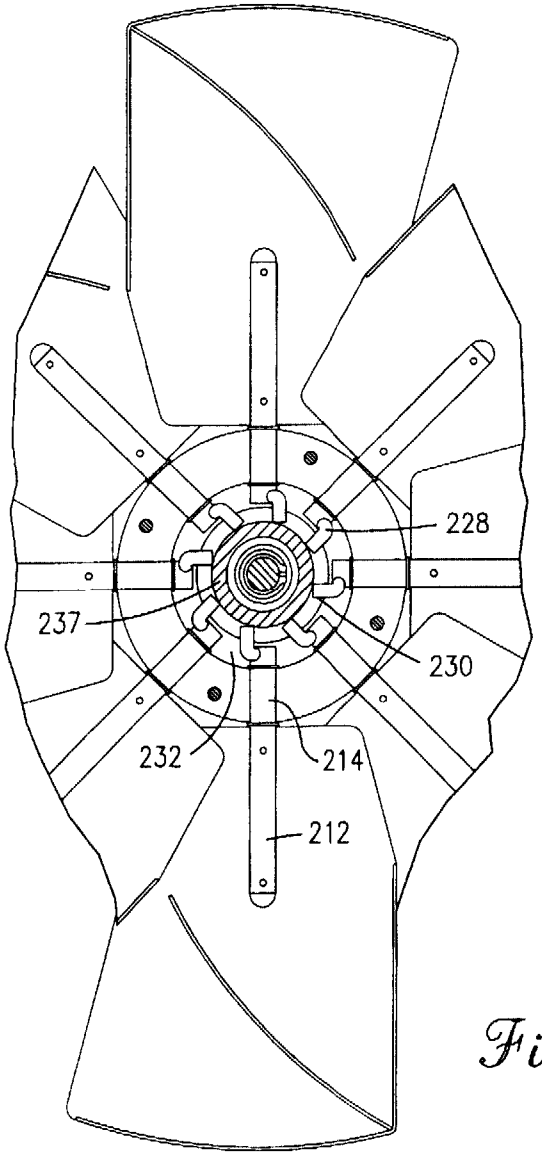
FIG. 7 is a right side sectional view of the air resistance assembly taken along line 7—7 of FIG. 5.

The bottom pivot section 216 is positioned within the hollow center 196 and has an L-shaped hook 228 secured to its bottom such that a portion of hook 228 extends outwardly to one side of the clamp and downwardly toward the hollow center. As shown in FIGS. 6 and 7, the bottoms of hooks 228 are securely fitted within apertures 230 extending circumferentially along the outside perimeter of an adjustment ring 232 fitted within the confines of the hollow center. As shown in FIGS. 5 and 6, pivotal adjustment of the blades is accomplished by moving adjustment ring 232 within a range of motion between one side of the hollow center of hub 180 and the opposite side of hollow center. Thus, as shown in FIG. 5 with respect to the rear resistance assembly, when the adjustment ring 232 is position on the left side of the hollow center, the blades 198 are positioned generally parallel the longitudinal axis of apparatus 10 so as to provide minimum air resistance to rotational movement of the fanwheel. As the adjustment ring 232 is moved toward the right side of the hollow center, hooks 228 are carried with the adjustment ring causing the spoke 210 to rotate and pivot the attached blade to a position generally transverse the longitudinal axis of the apparatus. In this manner, the blades may be pivoted within a ninety degree (90°) range of motion.

The adjustment ring 232 is moved by an adjustment assembly 234 comprising an adjustment shaft which extends transversely across apparatus 10 through the hollow center of hub 180 and is securely mounted through the adjustment ring 232. Means are provided to drive the adjustment shaft in a transverse direction within a limited range of motion so as to consequently move the adjustment ring 232 and pivot the blades 198 as discussed above. More specifically, looking to FIG. 3, adjustment assembly includes a controller 238 secured by a plate 240 to the right side of an adjustment block 242 which is mounted to the rear face of left rear vertical support 38*b* by bolts 244. A threaded bolt 246 extends transversely through the center of adjustment block 242 and is mounted for free rotation in a nut 248 secured on the internal wall of the adjustment block 242. The threaded bolt 246 and controller 238 are connected through a bore hole in plate 240 adjacent nut 248 such that controller 238 can drive rotational movement of the threaded bolt.

Figure 8:
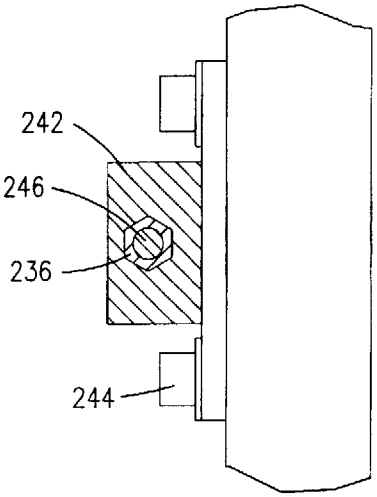
FIG. 8 is a right side sectional view taken along line 8—8 of FIG. 6.

As shown in FIGS. 5 and 6, the left end of adjustment shaft 236 includes a bore hole 250 that is threaded to cooperatively act with the threaded bolt 246. The threaded bolt is fitted within the bore hole such that rotational movement of bolt 246 drives the shaft away from the threaded bolt within a limited range of motion and rotational movement in the opposite direction draws the shaft toward the threaded bolt within that range of motion. In a preferred embodiment as shown in FIG. 8, the end of the shaft 236 is hexagonal in shape so as to fit within a channel 252 formed in adjustment block 242.

The adjustment shaft is housed within a cylindrical sleeve 254 extending transversely from the right face of vertical support 38*b* to the left hub facing 190*b*. Washers 256*a* & *b* are fitted between the left end of sleeve 254 and the vertical support 38*b* and between the right end of sleeve 254 and hub facing 190*b*. The adjustment shaft 236 extends through a central aperture 258 in the left and right hub facings 190 and a ring liner 260 is fitted between each facing and the shaft to permit free rotation of hub 180 about the shaft. The shaft 236 is journaled within a bearing 237 in the center of adjustment ring 232 such that the hub and adjustment ring can likewise rotate freely about the shaft. The shaft 236 is securely fitted to the adjustment ring by snap rings 264 such that the adjustment ring will be carried by the shaft upon transverse movement of the shaft.

As shown in FIGS. 5 and 6, the shaft extends outward the right hub facing 190*a* through a sleeve 266 in the center of smaller pulley 172 and into a cylindrical channel 268 formed in an adjustment block 270 attached via bolts 272 to the rear face of right vertical support 38*a*. Washers 274 are fitted between the smaller pulley 272 and adjustment block to allow free rotation of the pulley.

Controller 128 may simply comprise a knob for manually turning the bolt, or may be consists of any means known for turning the bolt such as a serado motor. The Controller may be connected to an input means provided on a control panel (not shown) or on one end of an arm lever handle as shown in FIG. 4. Preferably, the controller can be easily triggered by the user from his or her seated position so that the user can change the amount of resistance while exercising without changing the exercise pace or rpm. Insofar as the forward variable air resistance assembly 18 and rear variable air resistance assembly 24 are separate and independent of one another, a separate knob or input means will be operably connected to the controller for each assembly such that the user can indicate and trigger a different level of resistance for the leg press and arm press exercises respectively.

In operation, the user may adjust the amount of resistance for the leg press and/or the arm pull/arm press exercises by triggering the respective controller 128 to rotate threaded bolt 246. As discussed above, shaft 236 includes a threaded bore hole 250 which cooperatively acts with threaded bolt 246 such that the shaft may be moved transversely within a limited range of motion upon rotation of the bolt. The bolt 246 may be rotated forward to cause the shaft to move in one direction within this range of motion and rotated rearward to drive the shaft in the opposite direction. Adjustment ring 232 secured to the shaft 236 via snap rings 264 will be carried by shaft 236 between one side of the hollow center of the hub to the opposite side of the hollow center. As the adjustment ring 232 is moved, hook 228 will be rotated about the periphery of adjustment ring 232 causing blade 198 to pivot within a ninety degree (90°) range of motion between a position generally parallel the longitudinal axis of the apparatus (FIG. 5) providing minimal resistance to rotation of the fan wheel and a position generally transverse the longitudinal axis of the apparatus (FIG. 6) providing maximum resistance to rotation of the fan wheel.

From the foregoing it will be seen that this invention is one well adapted to attain all ends and objects hereinabove set forth together with the other advantages which are obvious and which are inherent to the structure. The apparatus 10 provides a frame 30 and seat assembly 12 which enable the user to be supported in a semi-recumbent position for purposes of conducting the exercises. The seat may be adjusted for different heights of users and the user may conduct different exercises on the machine at varied resistance.

In one embodiment, the user may perform a leg press exercise for developing or strengthening the leg muscles. In this embodiment, the user will grasp handles 72 at the side of seat cushion 46 and position his or her feet on foot pads 78. The user may then unlock the leg press beams to allow movement of the beams toward the user by triggering the controller 128 to release the leg press locking mechanism 118. The user may then adjust the amount of resistance to the leg press exercise by triggering adjustment of the forward variable air resistance assembly 18. As the user pushes his or her feet and legs forward, forward movement of the leg press beams 76 will cause the fan wheel of the forward variable air resistance assembly to rotate rearward creating air resistance to the leg movement. When the user's legs are fully extended, he or she will release the amount of pressure on the foot pads, allowing the helical springs 94 to urge the beams toward the user such that the user may then repeat the leg press cycle.

Alternatively, the user may opt to develop his or her arm, shoulder chest, back and stomach muscles by performing arm pulling/arm pressing exercises. In this embodiment, the user will leave the leg press beams 76 locked in place and simply rest his or her feet on the foot pads 78. The user may then adjust the amount of resistance for the arm pull/arm press exercise by triggering adjustment of the rear variable resistance assembly 24. The user will then grasp either the upper or lower arm handles 138 on each arm press lever 176 and reciprocate the levers alternatingly in a forward and rearward direction. Movement of the levers in this manner will cause the fanwheel on the rear variable air resistance assembly to rotate forward during both forward and rearward movement of the levers, thereby creating air resistance to the arm movement.

In yet another embodiment of the invention, the user may perform aerobic exercise by conducting the arm pull/arm press and leg press exercises described above at the same time. This requires full body motion on the part of the user. Since the arm pull/arm press and leg press exercises are independent of one another (as opposed to being tied for movement in unison), the user is required to exert more energy since pushing the leg press beams will not automatically cause movement of the arm levers.

It will be understood that certain features and subcombinations are of utility and may be employed without reference to other features and subcombinations. This is contemplated by and is within the scope of the claims. For example, it is contemplated that a semi-recumbent machine having independent arm and leg press assemblies may be provided using different resistance means other than an air resistance means. It is also contemplated that the air resistance and drive assemblies may be adapted for use on different types of exercise devices.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. An exercise apparatus which may be operated by a user for muscle development and/or cardiovascular development, said apparatus comprising: / a longitudinal frame having a forward end and a rear end for supporting the apparatus on the floor;

a seat assembly mounted toward the rear end of said frame for supporting a user in a semi-recumbent position;

a leg press assembly comprising a pair of leg press beams interconnected for concurrent movement, said leg press assembly being pivotally mounted toward the forward end of said frame to enable the user to perform a leg press exercise;

an arm pull/arm press assembly comprising a pair of arm levers interconnected for concurrent movement said arm press assembly being pivotally mounted to the frame intermediate the seat assembly and the leg press assembly to enable the user to perform an arm pull/arm press exercise, wherein said arm pull/arm press and leg press assemblies each operate independently of one another.

2. The apparatus of claim 1, wherein said apparatus additionally comprises:

a leg press resistance means for providing resistance against operation of the leg press assembly; and an arm pull/arm press resistance means for providing resistance against operation of the arm pull/arm press assembly, wherein each of said arm pull/arm press and leg press assemblies are operable against independent resistance means such that the amount of resistance to the leg press assembly may be different or varied from that of the arm pull/arm press assembly.

3. The apparatus of claim 2, wherein each of said arm pull/arm press and leg press resistance means comprises a variable resistance means such that the amount of resistance can be varied to different levels of resistance.

4. The apparatus of claim 3, wherein each of said arm pull/arm press and leg press resistance means comprises a variable air resistance means.

5. The apparatus of claim 4, wherein said variable air resistance means comprises:

a fanwheel having a central hub and at least one air vane extending circumferentially outward of said hub, wherein said air vane may be pivoted to provide variable air resistance against rotation of the fanwheel.

6. An exercise apparatus which may be operated by a user for muscle development and/or cardiovascular development, said apparatus comprising:

a longitudinal frame having a forward end and a rear end for supporting the apparatus on the floor;

a seat assembly mounted toward the rear end of said frame for supporting a user in a semi-recumbent position;

a leg press assembly pivotally mounted toward the forward end of said frame to enable the user to perform a leg press exercise;

a leg press resistance means for providing variable air resistance against operation of the leg press assembly, said resistance means comprising a fanwheel having a central hub and at least one air vane extending circumferentially outward of said hub, wherein said air vane may be pivoted to provide variable air resistance against rotation of the fanwheel;

an arm pull/arm press assembly pivotally mounted to the frame intermediate the seat assembly and the leg press assembly to enable the user to perform an arm pull/arm press exercise, wherein said arm pull/arm press and leg press assemblies each operate independently of one another;

an arm pull/arm press resistance means for providing variable air resistance against operation of the arm pull/arm press assembly, said resistance means comprising a fanwheel having a central hub and at least one air vane extending circumferentially outward of said hub, wherein said air vane may be pivoted to provide variable air resistance against rotation of the fanwheel.

7. The apparatus of claim 6, wherein seat assembly comprises:

a seat cushion and back cushion secured on a seat support so as to support the seat and back of the user in a semi-recumbent position during operation of the apparatus; and a movable base secured below the seat cushion to enable the position of the seat along the longitudinal frame to be adjusted to accommodate users of different height.

8. The apparatus of claim 6, wherein said seat assembly additionally comprises hand grips provided on either side of the seat cushion.

9. The apparatus of claim 6, wherein said leg press assembly comprises:

upwardly extending leg press beams pivotally mounted to either side of the front end of the longitudinal frame for reciprocating movement generally parallel the longitudinal axis of the frame, said leg press beams having an upper end and a lower end;

foot pads mounted on the upper end of said leg press beams to provide a flat surface upon which the user's foot may engage the beams; and a leg press crossbar extending transversely across the longitudinal axis of the frame and being pivotally mounted to said frame to enable rotational movement of the leg press crossbar, wherein said leg press beams are secured to each end of the leg press crossbar respectively such that movement of the beams is in unison about the rotational pivot axis of the leg press crossbar.

10. The apparatus of claim 6, wherein said arm pull/arm press assembly comprises:

arm levers extending outwardly and upwardly from either side of the longitudinal frame at a position intermediate the seat and leg press assemblies and pivotally mounted to the frame for forward and rearward reciprocating movement generally parallel the longitudinal axis of the frame, said arm levers having an upper end by which the user may grasp and move the levers, and having a lower end;

an arm pull/arm press crossbar extending transversely across the longitudinal axis of the frame and being pivotally mounted to said frame to enable rotational movement of the arm pull/arm press crossbar, wherein said arm pull/arm press levers are secured to each end of the crossbar respectively such that movement of the levers is in unison about the rotational pivot axis of the arm pull/arm press crossbar.

11. The apparatus of claim 6, wherein said hub comprises a pair of rounded hub facings fitted together to form a hub with a hollow center.

12. The apparatus of claim 11, wherein each of said at least one air vanes comprises a blade pivotally mounted to the hub by a cylindrical spoke such that the blades may be pivoted to a position generally parallel the longitudinal axis of the frame such that minimal air resistance is encountered as the fanwheel is rotated, or to a position generally transverse the longitudinal axis of the frame such that a maximum amount of air resistance is encountered as the fan wheel is rotated.

13. The apparatus of claim 12, wherein said blade has a front blade surface and a rear blade surface, and wherein said blade has a relatively straight bottom edge with side edges extending upwardly and outwardly from the bottom edge at an angle and a curvilinear top edge, a portion of one of said side edges and of the top edge is folded to form a flange extending generally perpendicular the direction of the front blade surface and an angled vein extends from the corner of the flange downwardly and transversely across the front blade surface.

14. The apparatus of claim 12, wherein said spoke comprises:

a top clamp section used to secure the blade to the spoke, said clamp section comprising two halves for securing the blade therebetween such that the bottom edge of the blade is flush with a bottom edge of the top clamp section;

an intermediate section positioned below the top clamp section and comprising a cylinder fitted for rotational movement within a bore hole in the hub such that the intermediate section extends from the outside of the hub to the hollow center of the hub; and a bottom pivot section positioned below the intermediate section and which provides a means by which the blade may be pivoted to adjust air resistance, said bottom pivot section being positioned within the hollow center of the hub and being pivotally mounted to an adjustment ring within the hollow center wherein pivotal adjustment of the blade is accomplished by moving the adjustment ring transversely within the hollow center.

15. The apparatus of claim 14, wherein the adjustment ring is moved by an adjustment assembly comprising:

an adjustment shaft extending transversely across the frame through the hollow center of the hub which is securely mounted to the adjustment ring such that movement of the shaft in the transverse direction will similarly cause transverse movement of the adjustment ring.

16. The apparatus of claim 14, wherein said adjustment assembly comprises:

a controller mounted to the frame;

a threaded bolt mounted transverse the longitudinal axis of the frame for free rotation on the frame, wherein said threaded bolt is operably connected to the controller such that the controller can control rotational movement of the threaded bolt; and an adjustment shaft mounted transverse the longitudinal axis of the frame having a first end and a second free end, wherein the first end of said adjustment shaft includes a bore hole that is threaded to cooperatively act with the threaded bolt such that rotational movement of the bolt drives the shaft within a limited range of motion in the transverse direction.

17. The apparatus of claim 6, wherein the leg press assembly is operably connected to the leg press resistance means by a drive assembly comprising:

a transversely extending drive shaft having one end journaled inside a single direction bearing such that the drive shaft may only be driven by thrust loads acting in a single direction;

a toothed gear mounted on the bearing for rotation with the drive shaft;

a pie-shaped gear having gear teeth along its upper curvilinear edge which correspond to that of the toothed gear, wherein said pie-shaped gear is affixed to the leg press crossbar so as to drive the toothed gear upon rotational movement of the leg press crossbar;

a pair of helical springs secured at one end to the pie-shaped gear and mounted at a second end rearward of the pie-shaped gear to the frame such that the helical springs urge the leg press beams rearward when little or no pressure is applied to the footpads;

a first pulley mounted for rotation with the drive shaft;

a second pulley coupled to the fanwheel for driving rotational movement of the fanwheel; and a belt connecting said first pulley to said second pulley so as to drive rotation of said second pulley.

18. The apparatus of claim 6, wherein the arm pull/arm press assembly is operably connected to the arm pull/arm press resistance means by an arm pull/arm press drive assembly comprising:

a drive shaft extending transversely across the frame having a left end and right end, wherein each of said ends is journaled inside left and right single direction bearings respectively such that the drive shaft may be driven by thrust loads acting only in one direction;

a right toothed gear mounted on the right bearing for rotation with drive shaft;

an idler gear secured to the frame for driving said right toothed gear;

a right pie-shaped gear having gear teeth along its upper curvilinear edge which correspond to that of the idler gear, wherein said pie-shaped gear is affixed to the arm pull/arm press crossbar so as to drive the idler gear upon rotational movement of the arm pull/arm press crossbar;

a left toothed gear mounted on the left bearing for rotation with the drive shaft;

a left pie-shaped gear having gear teeth along its upper curvilinear edge which correspond to that of the left toothed gear, wherein said pie-shaped gear is affixed to the arm pull/arm press crossbar so as to drive the left toothed gear upon rotational movement of the arm press crossbar;

a first pulley mounted for rotation with the drive shaft;

a second pulley coupled to the fan wheel for driving rotational movement of the fan wheel; and a belt connecting said first pulley to said second pulley, so as to drive rotational movement of said second pulley.

19. An exercise apparatus which may be operated by a user for muscle development and/or cardiovascular development, said apparatus comprising:

a longitudinal frame having a forward end and a rear end for supporting the apparatus on the floor;

a seat assembly mounted toward the rear end of said frame and including a seat cushion and back cushion secured on a seat support so as to support the seat and back of the user in a semi-recumbent position during operation of the apparatus, wherein said seat cushion is mounted on a movable base to enable the position of the seat along the longitudinal frame to be adjusted to accommodate users of different height;

a leg press assembly comprising upwardly extending leg press beams pivotally mounted to either side of the front end of the longitudinal frame for reciprocating movement generally parallel the longitudinal axis of the frame, said leg press beams each having an upper end upon which foot pads are mounted to provide a flat surface for the user's feet to engage the beams, and having lower ends secured to each end of a leg press crossbar, said crossbar being pivotally mounted to the frame such that movement of the beams is in unison about the rotational pivot axis of the leg press crossbar;

a leg press resistance means for providing resistance against operation of the leg press assembly;

an arm pull/arm press assembly including arm levers extending outwardly and upwardly from either side of the longitudinal frame at a position intermediate the seat and leg press assemblies and pivotally mounted to the frame for forward and rearward reciprocating movement generally parallel the longitudinal axis of the frame, said arm levers each having an upper end by which the user may grasp and move the levers, and having lower ends secured to each end of an arm pull/arm press crossbar, said crossbar being pivotally mounted on the frame such that movement of the levers is in unison about the rotational pivot axis of the arm pull/arm press crossbar; and an arm pull/arm press resistance means for providing resistance against operation of the arm pull/arm press assembly.

20. An apparatus according to claim 19, wherein said leg press resistance means and said arm pull/arm press resistance means each comprise:

a central fan wheel hub comprising a pair of rounded hub facings fitted together to form a hub with a hollow center;

at least one air vane extending outward of the hub for providing air resistance to rotation of the hub, said air vane comprising a blade pivotally mounted to the hub by a cylindrical spoke such that the blades may be pivoted within a range of motion between a position generally parallel the longitudinal axis of the frame such that minimal air resistance is encountered as the fanwheel is rotated to a position generally transverse the longitudinal axis of the frame such that a maximum amount of air resistance is encountered as the fan wheel is rotated; wherein said spoke includes a means for pivotally mounting the blade to an adjustment ring within the hollow center of the hub such that the blades may be pivoted within said range of motion by moving the adjustment ring transversely within the hollow center;

an adjustment assembly for moving said adjustment ring comprising an adjustment shaft extending transversely across the frame and securely mounted to the adjustment ring such that movement of the shaft in the transverse direction will similarly cause transverse movement of the adjustment ring; and means for moving the adjustment shaft in a transverse direction.

21. The apparatus of claim 19, wherein the leg press assembly is operably connected to the leg press resistance means by a leg press drive assembly comprising:

a transversely extending leg press drive shaft having one end journaled inside a single direction roller clutch bearing such that the leg press drive shaft may only be driven by thrust loads acting in a single direction;

a leg press toothed gear mounted on the roller clutch bearing for rotation with the leg press drive shaft;

a leg press pie-shaped gear having gear teeth along its upper curvilinear edge which correspond to that of the leg press toothed gear, wherein said leg press pie-shaped gear is affixed to the leg press crossbar so as to drive the leg press toothed gear upon rotational movement of the leg press crossbar;

a pair of helical springs secured at one end to the leg press pie-shaped gear and mounted at a second end rearward of the leg press pie-shaped gear to the frame such that the helical springs urge the leg press beams rearward when little or no pressure is applied to the footpads;

a first leg press pulley mounted for rotation with the leg press drive shaft;

a second leg press pulley coupled to the fanwheel of the leg press resistance means for driving rotational movement of the leg press resistance means; and a leg press belt connecting said first leg press pulley to said second leg press pulley so as to drive rotation of said second leg press pulley.

22. The apparatus of claim 21, wherein the arm press assembly is operably connected to the arm pull/arm press resistance means by an arm pull/arm press drive assembly comprising:

an arm press drive shaft extending transversely across the frame having a left end and right end, wherein each of said ends is journaled inside left and right single direction roller clutch bearings respectively such that the arm press drive shaft may be driven by thrust loads acting only in one direction;

a right toothed gear mounted on the right roller clutch bearing for rotation with drive shaft;

an idler gear secured to the frame for driving said right toothed gear;

a right pie-shaped gear having gear teeth along its upper curvilinear edge which correspond to that of the idler gear, wherein said right pie-shaped gear is affixed to the arm press crossbar so as to drive the idler gear upon rotational movement of the arm press crossbar;

a left toothed gear mounted on the left roller clutch bearing for rotation with drive shaft;

a left pie-shaped gear having gear teeth along its upper curvilinear edge which correspond to that of the left toothed gear, wherein said left pie-shaped gear is affixed to the arm pull/arm press crossbar so as to drive the left toothed gear upon rotational movement of the arm pull/arm press crossbar;

a first arm pull/arm press pulley mounted for rotation with the arm pull/arm press drive shaft;

a second arm pull/arm press pulley coupled to the fan wheel of the arm pull/arm press resistance means for driving rotational movement of the arm press resistance means; and an arm pull/arm press belt connecting said first arm pull/arm press pulley to said second arm pull/arm press pulley, so as to drive rotational movement of said second arm pull/arm press pulley.

* * * * *

UNITED STATES PATENT AND TRADEMARK OFFICE

CERTIFICATE OF CORRECTION

PATENT NO : 5,795,270

DATED : August 18, 1998

INVENTOR(S): Woods et al.

It is certified that error appears in the above-identified patent and that said Letters Patent is hereby corrected as shown below:

In Claim 1, column 14, line 16 of the Patent, after --comprising-- delete "/" and begin a new paragraph Signed and Sealed this First Day of December, 1998

*Attest:*

*Attesting Officer*

BRUCE LEHMAN

*Commissioner of Patents and Trademarks*